United States Patent [19]

Passien

[11] Patent Number: 4,998,317

[45] Date of Patent: Mar. 12, 1991

[54] COMBINED VACUUM AND FLUID LINE HOSE

[76] Inventor: Renold R. Passien, 8910 Hwy. 66, Klamath Falls, Oreg.

[21] Appl. No.: 380,154

[22] Filed: Jul. 13, 1989

[51] Int. Cl.[5] ..... A47L 9/24

[52] U.S. Cl. ..... 15/321; 15/345; 15/387; 174/47; 285/7; 285/134; 285/136

[58] Field of Search ..... 15/321, 345, 387; 285/7, 134, 136; 174/47

[56] References Cited

U.S. PATENT DOCUMENTS

| | | | |
|---|---|---|---|
| D. 239,243 | 3/1976 | Hachtmann et al. | D7/161 |
| 2,331,692 | 10/1943 | Hunt | 15/387 |
| 3,565,464 | 2/1971 | Wolf | 285/7 |
| 4,083,077 | 4/1978 | Knight et al. | 15/321 |
| 4,159,554 | 7/1979 | Knight et al. | 15/321 |
| 4,161,802 | 7/1979 | Knight et al. | 15/321 |
| 4,433,451 | 2/1984 | Parisi | 15/322 X |
| 4,488,330 | 12/1984 | Grave | 15/322 |
| 4,517,404 | 5/1985 | Hughes et al. | 285/7 X |
| 4,625,998 | 12/1986 | Draudt | 285/7 |

*Primary Examiner*—Chris K. Moore

*Attorney, Agent, or Firm*—Dority & Manning

[57] ABSTRACT

A vacuum hose/fluid line combination is provided for use with a vacuum cleaning system which includes a vacuum canister and heated fluid dispensing apparatus. The vacuum hose is devised with identical swivel cuffs at the ends thereof, each being formed with an opening in the cylindrical wall thereof and arranged to rotatably receive a flexible fluid dispensing line rotatably therethrough. The fluid line is retained within the hose and has its respective ends projecting outwardly through the openings for connection at one end to a hand tool, and at the other end to the fluid dispensing apparatus. Once connected, the vacuum hose is freely rotatable between the connection points.

13 Claims, 2 Drawing Sheets

COMBINED VACUUM AND FLUID LINE HOSE

BACKGROUND OF THE INVENTION

This invention relates generally to cleaning apparatus of the type particularly adapted for cleaning floors, and fabric such as carpeting, draperies, and upholstery by appropriate cleaning tools which incorporate a cleaning fluid sprayer and vacuum nozzle. It more particularly relates to a hose coupling arrangement providing improved operational and handling performance.

In recent years, fluid extraction methods have been utilized for cleaning floors, carpeting, draperies and furniture upholstery, in place of prior conventional shampoo methods which were found to be inefficient with respect to cleaning. In the typical shampoo methods, generally cleaning fluids were applied to the fabric as an initial step and allowed to set for a period of time so as to insure dissolving or dislodging of greases, stains and other forms of foreign particles to be conditioned for removal from the fabric. Later, as a separate step in the shampoo process, a vacuum cleaner was employed to remove the hopefully dislodged foreign particles.

During such initial shampoo applying step, a procedure was normally administered to scrub the fabric in order to assist in the dissolving and dislodging of the foreign matter. Such scrubbing action was not only potentially harmful to the fabrics themselves, but the scrubbing techniques could result in the driving of the dissolved foreign ingredients and particles deeper into the pile of the fabric, thereby preventing their desired complete removal during the later administered vacuuming step.

The fluid extraction method generally was a great improvement over the typical shampoo methods, not only because the more complete cleaning which was administered in a single step, but because simultaneous application of a vacuum with the cleaning detergent prevented dissolved and dislodged particles from being driven deeper into the fabric material. Various improvements to the fluid extraction methods have been proposed and sold in the marketplace as the technology progressed. In the early stages of fluid extraction apparatus, a pressurized fluid line was applied to a vacuum hose with binding tape, special plastic holders, snap-together bindings, and the like. However, the use of such a vacuum hose/fluid line combination resulted in operational difficulties because the flexibility of the vacuum hose was lost due to the attachment of a relatively stiff fluid pressure hose adapted for conveying fluid under high pressure and heat to the vacuum nozzle area. In other words, a relatively stiff, bulky hose is generally not readily manipulated to perform cleaning operations. In addition, these types of attachments still left portions of the pressure hose hanging loose whereby the portions would snare small pieces of furniture. In the case of truck mounted extractors, wherein a vacuum hose and pressure hose must be dragged into a house from the truck, it frequently snares and uproots small plants and lawn sprinklers.

In order to address such disadvantages, an arrangement was developed for incorporating the fluid hose within the vacuum hose so that both could be flexed and moved about an area to be cleaned with less difficulty. One example of such a commercial device is the upholstery cleaning tool of the KleenRite Company of Santa Barbara, Calif.

However, even in such later developments in the art, in general, the flexibility of a vacuum hose with an internally positioned fluid hose remains inadequate for easy handling of the vacuum nozzle or hand tool by an operator. Such later cleaning arrangements still require the operator to interrupt the cleaning process in order to reposition the various devices of the cleaning apparatus because of the lack of complete flexibility of the vacuum hose/fluid line combination.

In the use of such conventional fluid extraction hoses of the type as generally referenced above, fluid dispensing hoses or tubes are retained in vacuum hoses, and both of the hoses are connected at respective ends to a heated fluid dispensing apparatus and a cleaning tool, such as those which are hand held. In some instances, such commercial devices are constructed and arranged at relatively high expense to the consumer in that relatively high cost hose connections and fluid dispensing tube connections are utilized. For example, as generally shown in U.S. Pat. No. 4,083,077, a vacuum system utilized for fluid extraction methods is described as employing two entirely different constructions for the vacuum hose connections to the hand held tool and the fluid dispensing vacuum system. Perhaps the most significant disadvantage of the devices disclosed in this patent is that the tubular extensions and flow lines therein must be formed with sharp angles thereby reducing speed and fluid flow. Similarly, U.S. Pat. No. 4,159,554 discloses even more complicated hose connections for the vacuum system. In such patent, two fluid dispensing lines are utilized with coupling ends that are quite different from each other, thereby requiring specific additional parts for their function. Still another example of the complex and expensive arrangements in some prior art constructions is represented by U.S. Pat. No. 4,161,802, which describes an arrangement for cleaning draperies and the like. Design U.S. Pat. No. 239,243 also relates generally to fabric cleaning devices.

SUMMARY OF THE INVENTION

The present invention is provided in order to recognize and address various of the foregoing problems, limitations, and the like of prior art devices. Therefore, it is one principal object of the present invention to fabricate an improved device for use in the fluid extraction method for cleaning fabrics which utilizes a minimum number of parts, while providing a vacuum hose and separate fluid dispensing line associated therewith, for operative connection with a fluid dispensing vacuum apparatus and a hand held tool.

Another present object is to provide an improved hose which is readily manipulated during cleaning operations. More particularly, it is a present object to provide a hose having a generally central vacuum hose section which is freely rotatable relative end cuffs thereof. It is a further object to provide such a hose, wherein a fluid line received therein is also relatively rotatable with reference to such end cuffs, whereby flexibility and manipulation of the entire arrangement is improved.

Another general object of the present invention is to provide a combination vacuum hose/fluid dispensing line arrangement which is identical on each end for connection with any devices (vacuum cleaner/heated fluid dispensing apparatus or cleaning tool) of a cleaning system. In particular, an arrangement has been presently devised wherein the vacuum hose and the fluid dispensing line generally mounted therein are preferably provided with identical end connection parts so that either end of the vacuum hose and the fluid dispensing line may be interchangeably connected with either a fluid dispensing vacuum apparatus or a cleaning tool, without the need for intervening or intermediate structure. In this manner, inventory of additional or different parts is minimized and the consumer cost factor is greatly reduced for the coupling structures.

Additional objects and advantages of the invention are set forth, or will be apparent to those of ordinary skill in the art, from the detailed description that follows. Also, it should be appreciated that modifications and variations to the specific illustrated and discussed features hereof may be practiced in various embodiments and uses of this invention without departing from the spirit and scope thereof, by virtue of present reference thereto. Such variations may include, but are not limited to, substitution of equivalent means and features for those shown or discussed, and the reversal of various parts or the like.

Still further, it is to be understood that different embodiments, as well as different presently preferred embodiments of the present invention, may include various combinations of presently disclosed features, or their equivalents (including combinations not expressly shown or stated). One exemplary such embodiment of the present invention relates to a cleaning attachment, comprising a vacuum hose having a dispensing fluid line retained therein, with one end of the hose adapted for association with a vacuum cleaner/heated fluid dispensing apparatus, and the other end of such hose adapted for association with a cleaning tool such as a wand, a power brush or a hand held tool; and a swivel coupling member rotatably retained at one end of the vacuum hose, and adapted to be detachably connected to one of a vacuum cleaner/ fluid dispensing apparatus and a cleaning tool. Preferably, the swivel member is provided with an opening formed in the wall thereof through which an end portion of the dispensing fluid line exits, and is received therein, whereby the vacuum hose and fluid line are prevented from twisting and coiling as the cleaning tool is manipulated during cleaning operations.

Another present exemplary apparatus relates to a fabric cleaning vacuum hose, having a dispensing fluid line retained therein, such hose being arranged for connection at one end to a combination vacuum/fluid cleaning apparatus, and to a hand held tool at the other end thereof. Such arrangement preferably further has first and second swivel coupling members rotatably retained at the respective ends of the vacuum hose and adapted for connection to a source of vacuum and the hand held tool, respectively, whereby the vacuum hose is freely rotatably relative the coupling members on either end thereof, to prevent twisting and coiling of the hose while the hand held tool is manipulated during a cleaning process.

Yet another construction comprising an exemplary embodiment includes an apparatus for use in the fluid extraction cleaning of fabric utilizing a dispensing fluid apparatus and a cleaning tool. Such apparatus preferably comprises a vacuum hose having a coupling cuff freely rotatably supported at each end thereof, each of such cuffs having an opening formed through the side walls thereof; and a fluid dispensing fluid line generally received within the vacuum hose, such line having respective end portions projecting through and rotatably received in the cuff openings, and the end portions each terminating in a tube fitting. The coupling cuff members and tube fittings are preferably adapted to be connected interchangeably with either a dispensing fluid apparatus or a cleaning tool, whereby the vacuum hose is supported and interconnected freely rotatable therebetween.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
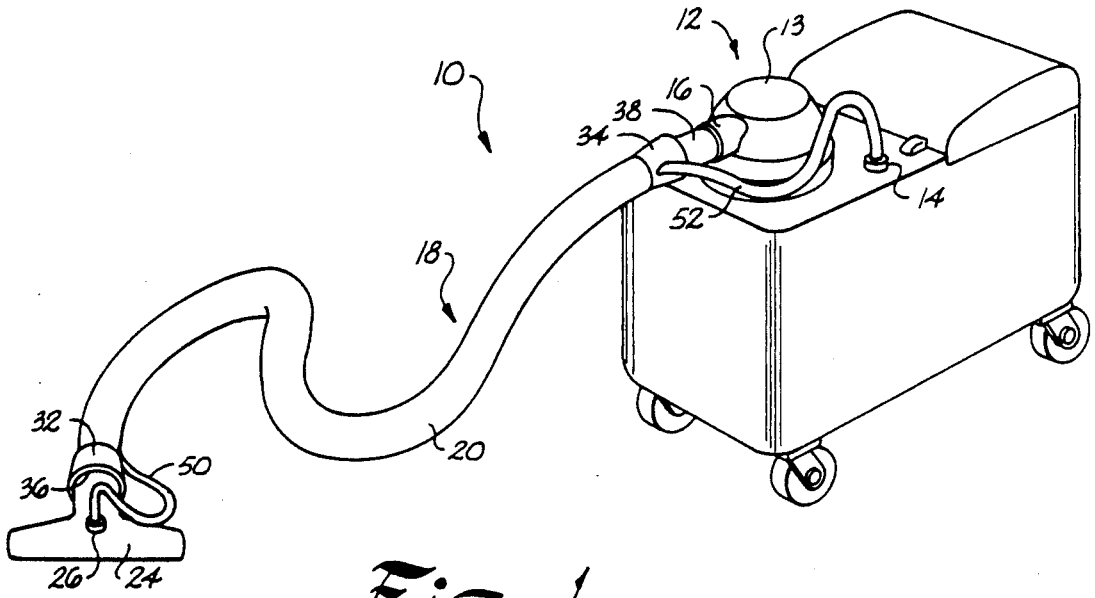
FIG. 1 is an isometric view of an exemplary vacuum and fluid cleaning system for use in a fluid extraction process, with an embodiment of the present invention.

Repeat use of reference characters throughout the present specification and appended drawings is intended to represent same or analogous features or elements of the invention.

DETAILED DESCRIPTION OF A PREFERRED EMBODIMENT

As shown in FIG. 1, an exemplary vacuum cleaning system 10 for use such as in cleaning fabric or the like, includes a vacuum and fluid dispensing apparatus generally indicated by reference numeral 12. As known, the apparatus 12 may include an interior heated fluid solution dispensing tank (not shown), a vacuum canister 13 and associated controls, and piping fixtures for use in the fluid extraction method. A suitable tube fitting 14 and vacuum hose connector 16 may be provided on the outside of apparatus 12 for respective connection of a fluid dispensing line to the interior dispensing tank associated therewith, and connection of a vacuum hose to the vacuum canister 13.

Figure 2:
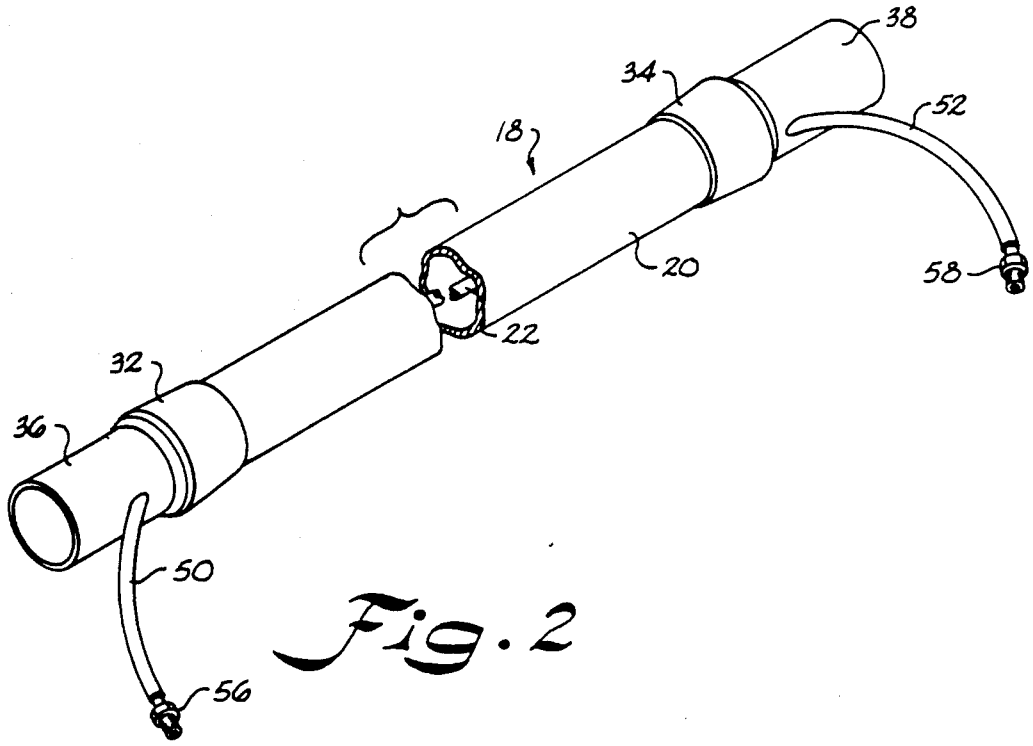
FIG. 2 is an enlarged isometric view, in partial cutaway, of an exemplary vacuum hose/fluid dispensing line arrangement in accordance with this invention.

Vacuum cleaning system 10 may use a vacuum hose/fluid dispensing line construction 18 provided in accordance with the present invention, and arranged so that a generally flexible vacuum hose 20 thereof is connected to vacuum canister 13 by way of connector 16. Apparatus 18 also preferably includes a flexible fluid dispensing pipe or line 22 which is retained generally within vacuum hose 20 for most of the entire length thereof (see present FIGS. 2 through 4).

As is common to typical vacuum hoses, hose 20 may be fabricated of flexible, air-tight material (such as plastic, rubber, or the like) which ordinarily permits an operator or user to move about freely during vacuum cleaning operations. The end of apparatus 18 remote from vacuum canister/fluid dispensing apparatus 12 is adapted for connection to a suitable vacuum/sprayer cleaning tool such as a hand tool 24 (see present FIG. 1). While a specific hand held tool is illustrated, it will be understood that other forms of cleaning tools such as the conventional carpet wand and a power brush may be substituted. Details of such a hand tool 24 are not necessary for a complete understanding and appreciation of the present invention since typical prior art hand tool constructions may be practiced in association with practice of this invention. One such hand tool in conventional use comprises a brush or the like mounted across an opening formed in the tool for application against fabric to be cleaned, with a spraying nozzle arranged for spraying dispensing fluid during cleaning operations onto fabric to which the hand tool is applied. As is further conventional, a fitting 26 may be provided on the tool for permitting the connection of a fluid hose to the sprayer nozzle contained therein.

As represented in the Figures, vacuum hose 20 in one present exemplary construction preferably comprises an elongated flexible hose section having a pair of cylindrical members 32 and 34 secured about the respective ends thereof. Each of such members 32 and 34 are associated with supporting coupling cuff (or swivel coupling) members 36 and 38 respectively by adjacent annular flanges 40 and 42 retained within an interior circular groove 44 formed in each of cylindrical members 32 and 34. Each end of hose 20 preferably has an annular flange 40 for free rotatable receipt thereof in an annular groove or its equivalent; however, some embodiments of the invention may be practiced with such swivel cuff features on only one end of the hose construction.

The cuff members are preferably formed with an opening 46 in the wall thereof, and are also formed with a cylindrical, inwardly projecting tubular element (stub tube) 48 extending angularly inward relative the cuff wall and surrounding the cuff opening 46. Tube 48 receives a part of fluid line 22 to help guide and support same. In particular, an end portion 50 of fluid line 22 projects outwardly from hose 20 through the cuff opening 46 positioned within tubular element 48. Fluid line 22 is also preferably adapted to rotate about its longitudinal axis within tubular element 48 during operative use of vacuum hose 20, and with a relatively tight seal maintained between the outside walls of such section 50 and the inner wall of element 48 (to minimize leakage of air therebetween during vacuum cleaning operations).

Figure 3:
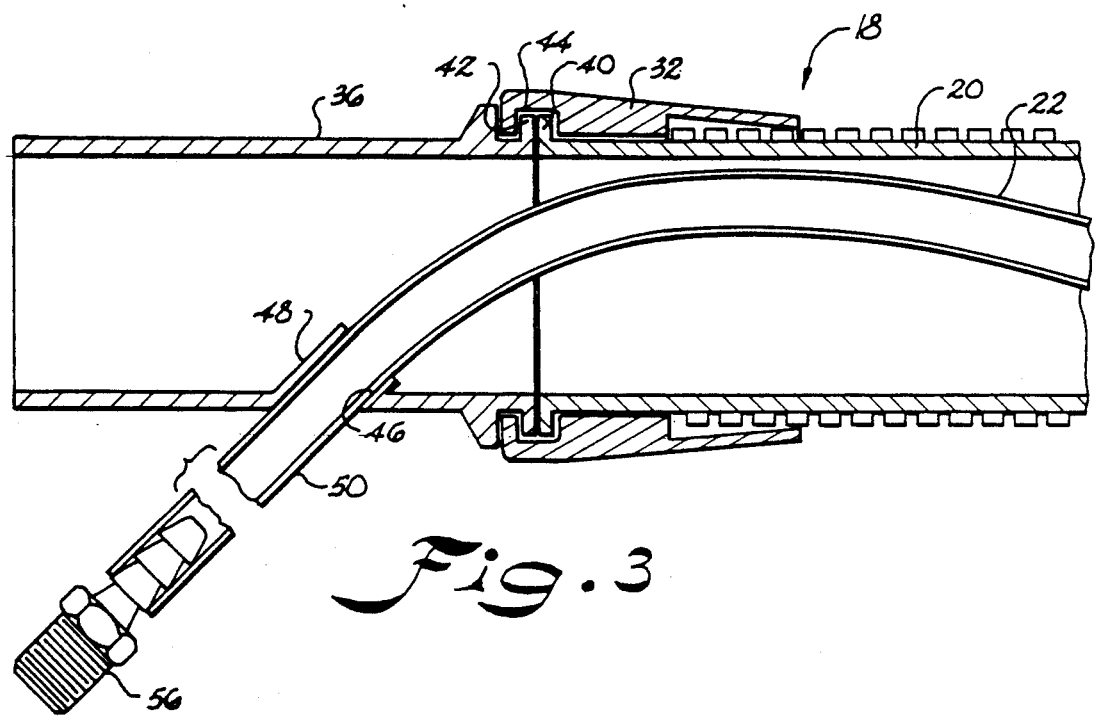
FIG. 3 is an enlarged cross-sectional view, taken along the lengthwise axis of one end of an exemplary embodiment of the present invention.
Figure 4:
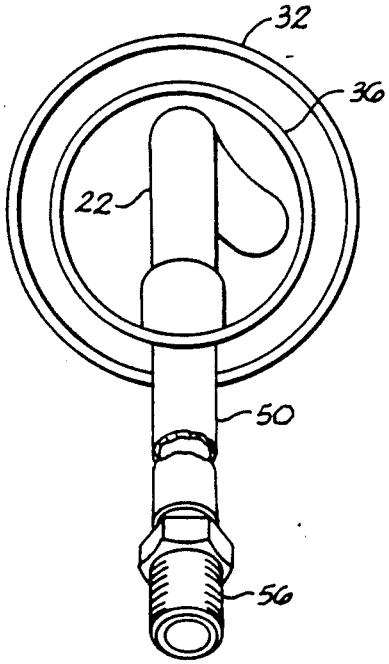
FIG. 4 is an end elevational view of a present exemplary construction, such as that represented in present FIG. 3.

Similarly, the other end of line 22 may likewise terminate in a hose section 52 which projects from an opening in cuff 38 similar to opening 46 of FIG. 3, and optionally with an equivalent tubular element 48 associated with such cuff 38.

A pipe fitting 56 or the like may be secured to the free end of section 50, and adapted to be threadably secured to fitting 26 on hand tool 24. The free end of hose section 52 also terminates in a fitting 58 adapted to be threadably received in fitting 14 associated with tank/-canister apparatus 12.

For operation, cuff 36 is inserted into hand tool 24 (also serving as an integral connector) and cuff 38 is inserted in a mating connector 16 mounted on the vacuum canister 13. Such arrangement connects hand tool 24 with apparatus 12 to comprise vacuum system 10. Hose sections 50 and 52 are connected to fittings 26 and 14, respectively, thereby fully preparing the vacuum hose/fluid line construction 18 in accordance with this invention for vacuum and fluid dispensing operation. Of course, if identical fitting sizes and types are involved, then the ends of construction 18 may be reversed as between apparatus 12 and hand tool 24 without any change in or affect to cleaning operations of system 10. Thus, objects of general simplicity and interchangeability are obtained.

During cleaning operations, as an operator manipulates hand tool 24 (or some other attachment) relative to floor carpeting, draperies, furniture upholstery, or the like, construction 18, provided in accordance with this invention, is advantageously free to flex and be freely movable relative to apparatus 12. In particular, during manipulations, cuff members 36 and 38 are free to rotate relative to cylindrical members 32 and 34, respectively, because of the swivel connection therebetween. Thus, vacuum hose portion 20 is, in effect, free to rotate relative coupling cuffs 36 and 38, entirely without detriment to any cleaning operations.

During the rotating or swiveling action of the cuffs 36 and 38, fluid line sections 50 and 52 remain relatively stationary due to their fixed connections with fittings 14 and 26. Since line sections 50 and 52 are adapted to rotate within openings 46 (and within tubular elements 48), the fluid line 22 does not impede the rotating action of cuff members 36 and 38. Hence, while vacuum hose 20 is advantageously free to rotate about its longitudinal axis for flexing action and movement of hand tool 24, fluid line 22 remains relatively fixed (rather than rotating) along its longitudinal axis. It is to be noted that the end sections 50, 52 provide a gentle curve flow of fluid, thereby eliminating any restriction of fluid flow at the entrance and exit points.

In another embodiment of the present invention, the vacuum hose/fluid dispensing line 18 may be utilized with air driven power tools wherein the line 22 may conduct air under high pressure to an air tool and the hose 20 serving to remove debris, dust and chips produced by the tool during operation thereof. In this embodiment, the coupling cuff member 36 would be applied to the air tool and the fitting 58 connected to a source of air pressure.

From the foregoing, it will be appreciated by those of ordinary skill in the art that the present invention provides an arrangement whereby a vacuum hose and fluid dispensing line may be combined and manipulated extensively without injuring the fluid dispensing line and without impeding cleaning operations of the operator. It will also be appreciated that the present vacuum hose/fluid line combined construction 18 may be interchangeable with respect to its connections with apparatus 12 and hand tool 24, or any other type of cleaning tool, thereby relieving the operator from the task of determining which ends of the hose to connect to the working devices of this system. Further, the invention provides an arrangement whereby the structure at the ends of the vacuum hose are duplicated, thereby minimizing the cost factor relative to the supply of parts, as well as the original construction cost to the consumer.

Those of ordinary skill in the art will also understand and appreciate that the foregoing specification references to the accompanying figures is intended merely as a description of a specific exemplary embodiment, and is not intended as limiting the spirit and scope of the present invention, which is set forth in the appended claims.

What is claimed is:

1. A cleaning attachment, comprising:

a vacuum hose having a dispensing fluid line retained therein, with one end of said hose adapted for association with a vacuum cleaner/ heated fluid dispensing apparatus, and the other end of said hose adapted for association with a cleaning tool; and a swivel coupling member rotatably retained at one end of said vacuum hose, and adapted to be detachably connected to one of a vacuum cleaner/heated fluid dispensing apparatus and a cleaning tool;

wherein said swivel coupling member has an opening formed in the wall thereof through which an end portion of the dispensing fluid line exits, and is rotatably received therein, whereby the vacuum hose and fluid line are prevented from twisting and coiling as the cleaning tool is manipulated during cleaning operations.

2. A cleaning attachment as in claim 1, further including a second swivel coupling member rotatably received on the other end of said vacuum hose, whereby said vacuum hose is independently rotatable between said swivel coupling members, said second swivel coupling member also having an opening for rotatable receipt of said fluid line therethrough.

3. A cleaning attachment as in claim 1, wherein said vacuum hose comprises a flexible plastic tube.

4. A cleaning attachment as in claim 1, wherein said vacuum hose one end has an annular flange thereabout and said swivel coupling member has a matching annular flange situated adjacent to said hose annular flange, and wherein said attachment further includes a cylindrical member commonly received about said annular flanges, and defining an inner circular groove for rotatable receipt of said flanges therein, whereby said hose and coupling member are freely rotatably joined relative one another.

5. A cleaning attachment as in claim 1, further including a tubular element integrally formed with said swivel coupling member and associated with said opening thereof, for receipt and support of said fluid line therein.

6. A fabric cleaning vacuum hose, having a dispensing fluid line retained therein, said hose being arranged for connection at one end to a combination vacuum/fluid cleaning apparatus, and to a cleaning tool at the other end thereof, and further having first and second swivel coupling members rotatably retained at the respective ends of said vacuum hose and adapted for connection to a source of vacuum and a cleaning tool, respectively, whereby said vacuum hose is freely rotatable relative said coupling members on either end thereof, to prevent twisting and coiling of said hose while the hand held tool is manipulated during a cleaning process, and further wherein said first and second swivel coupling members have openings formed in the walls thereof, through which respective end portions of said dispensing fluid line exit, such end portions being rotatably related to the respective swivel coupling members, whereby such end portions of said fluid line are free to rotate relative thereto during a cleaning process.

7. A hose as in claim 6, wherein each of said end portions of said fluid line terminates in a tube fitting adapted to be connected to a cleaning apparatus or a cleaning tool, respectively.

8. A fabric cleaning vacuum hose, having a dispensing fluid line retained therein, said hose being arranged for connection at one end to a combination vacuum/fluid cleaning apparatus, and to a cleaning tool at the other end thereof, and further having first and second swivel coupling members rotatably retained at the respective ends of said vacuum hose and adapted for connection to a source of vacuum and a cleaning tool, respectively, whereby said vacuum hose is freely rotatable relative said coupling members on either end thereof, to prevent twisting and coiling of said hose while the hand held tool is manipulated during a cleaning process, wherein said swivel coupling members each comprise a generally annular cuff with an annular flange about the outside diameter thereof, said annular flange being adapted for receipt and rotation in a circular receiving groove of a member supported on said hose, and further wherein said annular cuff includes an opening formed through the circumference thereof, and a stub tube integrally formed with said cuff, and in communication with said opening, said tube and opening being adapted for receipt and support of said fluid line, whereby such line communicates between the inside and outside of said vacuum hose.

9. Apparatus for use in the fluid extraction cleaning of fabric utilizing a dispensing fluid apparatus and a cleaning tool, said apparatus comprising:

a vacuum hose having a coupling cuff freely rotatably supported at each end thereof, each of said cuffs having an opening formed through the side walls thereof; and a fluid dispensing fluid line generally received within said vacuum hose, said line having respective end portions projecting through and rotatably received in said cuff openings, and said end portions each terminating in a tube fitting;

wherein said coupling cuff members and said tube fittings are adapted to be connected interchangeably with either a dispensing fluid apparatus or a cleaning tool, whereby said vacuum hose is supported and interconnected freely rotatable therebetween.

10. Apparatus as in claim 9, wherein said hose and coupling cuffs have respective, adjacent pairs of annular flanges at each end of said hose, and said apparatus further includes cylindrical members received about said flange pairs at each hose end, said cylindrical members defining an annular groove for common rotatable receipt of said flange pairs, whereby said cuffs are freely rotatably received on said hose ends.

11. Apparatus as in claim 9, wherein said cuffs further includes relatively short guide tubes integrally formed within the interior thereof, and in communication with said cuff openings, said tubes receiving and further supporting said fluid line therein.

12. A cleaning attachment, comprising: a vacuum hose having an air pressure line retained therein, with one end of said hose adapted for association with a vacuum cleaner, and the other end of said hose adapted for association with an air driven tool; and a swivel coupling member rotatably retained at one end of said vacuum hose, and adapted to be detachably connected to one of a vacuum cleaner and an air driven tool;

wherein said swivel coupling member has an opening formed in the wall thereof through which an end portion of said air pressure line exits, and is rotatably received therein, whereby the vacuum hose and said air pressure line are prevented from twisting and coiling as the air driven tool is manipulated during cleaning operations.

13. A cleaning attachment as in claim 12, further including a second swivel coupling member rotatably received on the other end of said vacuum hose, whereby said vacuum hose is independently rotatable between said swivel coupling members, said second swivel coupling member also having an opening for rotatable receipt of said air pressure line therethrough.

* * * * *

UNITED STATES PATENT AND TRADEMARK OFFICE

CERTIFICATE OF CORRECTION

PATENT NO. : 4,998,317

DATED : March 12, 1991

INVENTOR(S) : Renold R. Passien

It is certified that error appears in the above-identified patent and that said Letters Patent is hereby corrected as shown below:

Colume 8, line 41, Claim 11, change "includes" to --include--.

Colume 8, line 45, Claim 12, after "comprising:" begin a paragraph with "a vacuum ...".

Signed and Sealed this

Eighteenth Day of August, 1992

*Attest:*

DOUGLAS B. COMER

*Attesting Officer*

*Acting Commissioner of Patents and Trademarks*